United States Patent [19]

Stark

[11] 4,234,032

[45] Nov. 18, 1980

[54] ROLLER BLIND BOX

[75] Inventor: Gerd Stark, Bergisch Gladbach, Fed. Rep. of Germany

[73] Assignee: Dyna Plastik-Werke GmbH, Bergisch Gladbach, Fed. Rep. of Germany

[21] Appl. No.: 971,638

[22] Filed: Dec. 20, 1978

[30] Foreign Application Priority Data

Mar. 1, 1978 [DE] Fed. Rep. of Germany ... 7806067[U]

[51] Int. Cl.[3] ..... E06B 9/08

[52] U.S. Cl. ..... 160/261; 160/133

[58] Field of Search ..... 160/26, 133

[56] References Cited

U.S. PATENT DOCUMENTS 3,158,195 11/1964 Ney ..... 160/26

FOREIGN PATENT DOCUMENTS 1801169 4/1970 Fed. Rep. of Germany ..... 160/133

2206769 7/1977 Fed. Rep. of Germany ..... 160/133

*Primary Examiner*—Peter M. Caun

*Attorney, Agent, or Firm*—Browdy and Neimark

[57] ABSTRACT

A roller blind box includes four longitudinal walls and two face walls interconnecting the longitudinal walls. The face walls support a roller blind shaft and are connected via detachably carried guide members to the lateral roller blind guides. Each face wall is formed symmetrical in relationship to a vertical plane passing through the axis of the roller blind shaft. At each of the lower corners of each face wall there is an insertion opening for receiving a respective guide member.

7 Claims, 9 Drawing Figures

ROLLER BLIND BOX

BACKGROUND OF THE INVENTION

This invention relates to a roller blind box, the side walls of which carry face walls, which are inserted into the side walls, interconnecting same, which support a roller blind shaft and are connected via detachably carried guide members to the roller blind guides.

In a prior art roller blind box of this type, the face walls are made double-walled, and the partial wall facing the interior of the roller blind box is opened. Thus, for an assembly of the roller blind box of prefabricated parts, four longitudinal walls and two face walls are required differing from one another in their structures. Considerable storage space is consequently required.

An object of the present invention is to improve the prior art roller blind boxes so that only a single face wall is required which is shaped in such a way that it cannot only be used for each of the two sides, but in addition thereto also in such a way that the roller blind box may be used for left-hand or right-hand rolling.

SUMMARY OF THE INVENTION

According to the invention, it is provided that each face wall is formed symmetrical with respect to a vertical plane passing through the axis of the roller blind shaft, the vertical plane being perpendicular to this axis, and that at each of the two lower corners of each face wall there is an insertion opening for receiving a guide member.

In this way, the face wall formed in this fashion may be used both as a left-hand and as a right-hand termination wall for the roller blind box without additional passages having to be provided or breakouts having to be made.

For a face wall which carries a push-in guide inwardly displaced by the wall thickness of the longitudinal walls, the push-in guide in furtherance of the invention may include four strips formed integrally with the face wall, the widths of which are in excess of that of a roller blind belt. The strip adjacent to the lower longitudinal wall preferably has breakouts in the corner regions defining the insertion openings. Thereby, it is permitted to provide at the inner surface of the face wall a drive for the roller blind shaft which includes either belt wrapping pulleys or a cone drive.

The insertion openings are preferably formed polygonal and merge into an insertion channel closed at the end in order to be able to connect the guide members which represent the connection between the face walls and the lateral roller blind guides to the face wall in the proper position.

Since the gearing rods leading to the bevel wheel drives for the roller blind shaft must have different exit openings for right-hand and left-hand rollers, recesses are provided in the lower strip and in the lateral strips adjacent to the insertion guides and above thereof, the recesses permitting a passage of a gearing rod.

When, instead of a bevel gear, drive belt pulleys are used for the operation of the roller blind shaft, the lateral strips are provided with recesses in the vicinity of their upper ends, preferably, said recesses permitting the passage of a roller blind belt.

In order to be able to connect the guide members non-rotatably to the face walls, each guide member includes an insertion arbor formed according to the cross-section of the insertion opening and an inlet funnel laterally adjacent to the outer end thereof.

In order to be able to assemble the inlet funnel in alignment with the roller blind guide, tabs preferably project from the side of the inlet funnel remote from the insertion arbor, these tabs being insertible into a roller blind guide.

In order to prevent a lateral displacement of the individual sections defining the roller blind assembly and in order to prevent an intrusion of outside atmosphere via the part of the inner space of the roller blind box receiving the roller blind assembly into a living space, the face walls are each covered by a plate. Since these must have a passage opening for the roller blind shaft, outside atmosphere is nevertheless able to intrude into the living space through the annular gap about the shaft. In order to avoid this, the roller blind shaft has a cylindrical end portion, and the annular gap between this end portion and the edge of the passage opening is closed by a seal.

BRIEF DESCRIPTION OF THE DRAWINGS

An embodiment of a roller blind box according to the present invention has been illustrated in the accompanying drawings, wherein.

DETAILED DESCRIPTION OF THE PREFERRED EMBODIMENT

Figure 1:
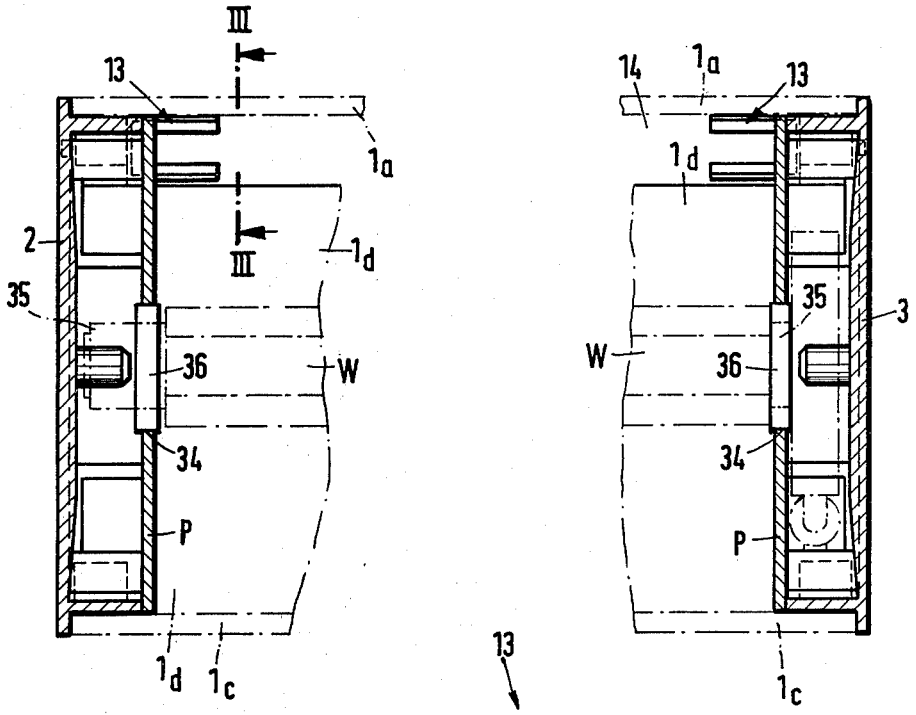
FIG. 1 is a horizontal longitudinal sectional view of the roller blind box.

The roller blind box has four longitudinal walls 1*a, b, c, d* and includes two face walls 2 and 3. The face walls 2 and 3 are pushed into the channel-like roller blind box defined by the longitudinal walls 1*a, b, c, d* from both sides. They thereby rigidify the roller blind box and serve to connect the longitudinal walls 1*a, b, c, d* to one another. For a rigidification of the roller blind box, each face wall 2 or 3 carries strips 4, 5, 6, and 7 projecting from the edge in a spacing corresponding to the thickness of the longitudinal walls. In the middle of each face wall, a rotary spigot 8 for the roller blind shaft directed in the same direction as the strips 4,5,6,7 is firmly connected to the face walls 2, 3.

The strip 6 adjacent to the lower longitudinal wall carries reinforcements 9, 10 at both corners, in which insertion openings 11, 12 are provided. These openings receive an insertion arbor of a guide member 13 which serves to connect the face walls 2, 3 to a roller blind guide. In FIG. 2 of the drawings, such a guide member 13 has been illustrated which is inserted into the insertion opening 11 positioned at the top in FIG. 1 of the drawings.

Figure 2:
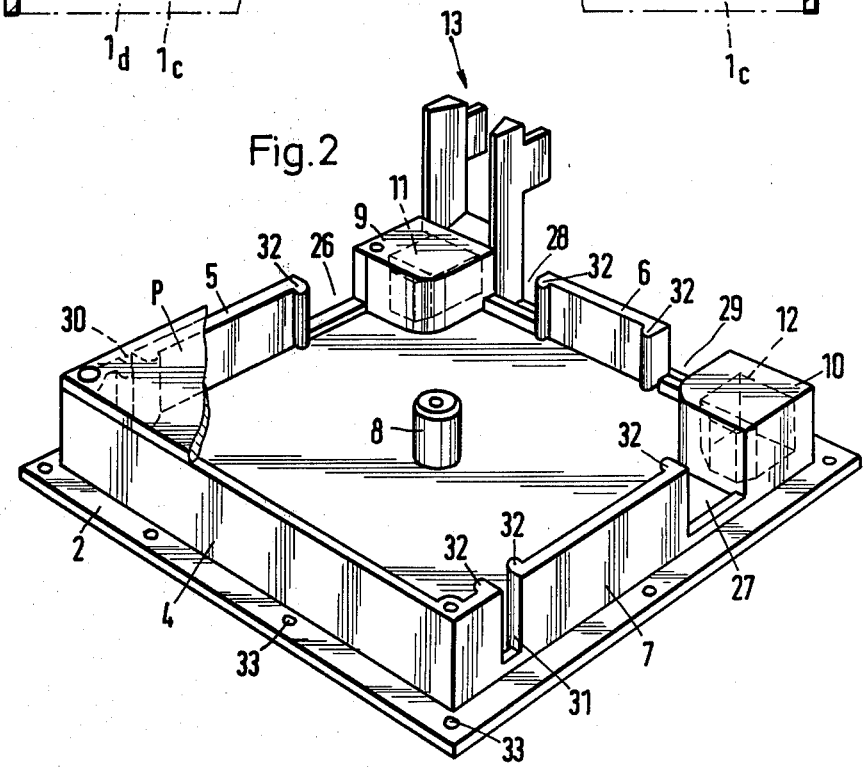
FIG. 2 is a perspective illustration of the face wall illustrated at the left hand of the drawings, the covering plate being broken away.

As shown in FIG. 1, the lower longitudinal wall 1*d* of the roller blind box has a slit 14 at this location for the passage of the roller blind assembly.

A covering plate P is respectively applied to the face walls 2 and 3, this covering plate dividing the interior space of the roller blind box in communication with outside atmosphere from the interior of the face walls 2 or 3. Since the roller blind shaft extends through the covering plate P, a passage opening 34 is provided therein. In order to prevent the outside atmosphere from entering and contacting the interior of the face walls 2 or 3 from the interior of the roller blind box, the end portion 35 of the roller blind shaft W is formed cylindrical, and the annular gap between this end portion and the edge of the passage opening 34 is closed by a seal 36.

Figure 3:
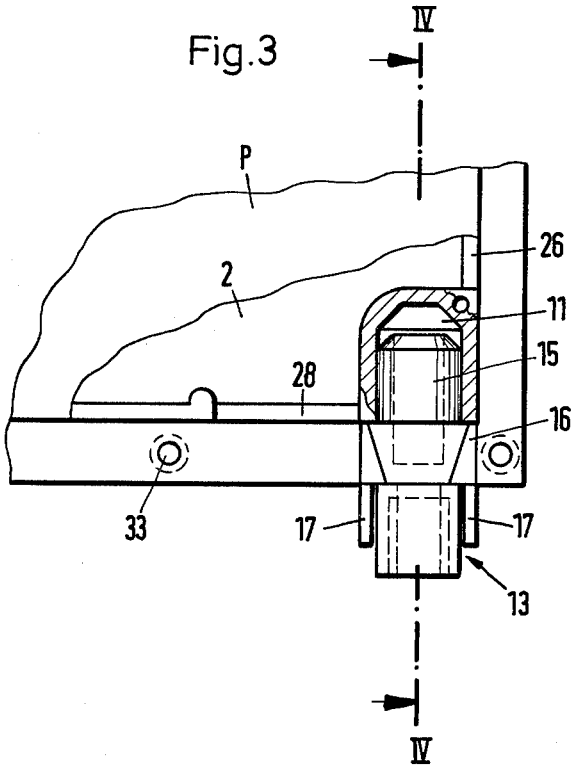
FIG. 3 is a partial view illustrated partially broken away, as viewed from the plane designed by section line III—III of FIG. 1, however, with the covering plate being omitted.
Figure 4:
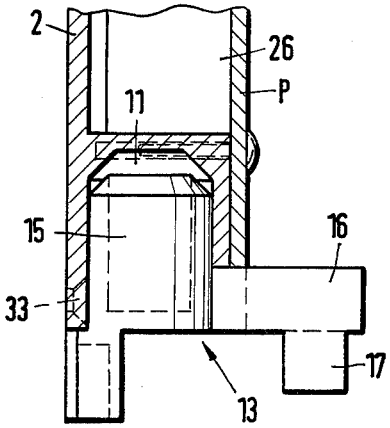
FIG. 4 is a sectional view taken along section line IV—IV of FIG. 3, the covering plate being illustrated, however.

As will be noted from FIGS. 3 and 4, the guide member 13 includes an insertion arbor 15 introducable into an insertion opening 11 or 12 and an inlet funnel 16, which, as will be noted from FIG. 2, projects from the face wall 2. From the side of the inlet funnel 16 remote from the insertion arbor 15, two tabs 17 project which serve to aligningly introduce the guide member 13 into a roller blind guide. The inlet funnel is, as will be noted from FIG. 3, formed tapered toward the roller blind guide, so that the individual strips of the roller blind are reliably fed to the slit 14 when rolling off the roll.

Figure 5:
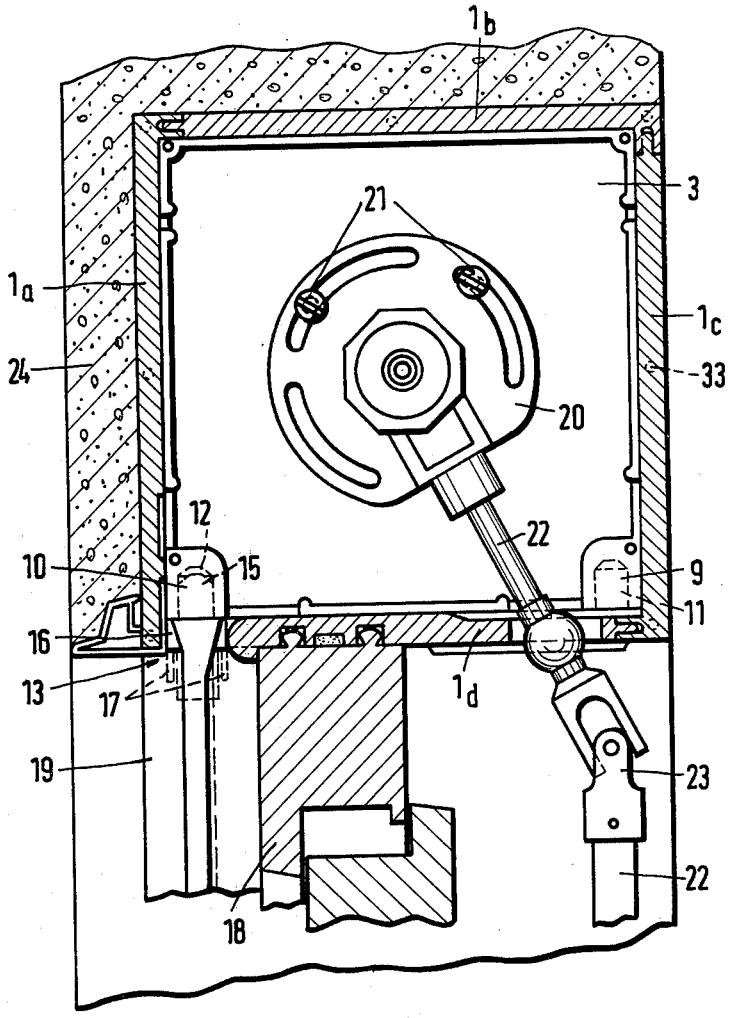
FIG. 5 is a cross-sectional view of the roller blind box.

In FIG. 5 of the drawings, a cross section of an assembled roller blind box has been illustrated. The roller blind box is connected with its lower longitudinal wall to the top portion of a window frame 18. At the left hand side of the window frame, as viewed in the drawing, the roller blind guide 19 is connected thereto. The face wall 3 carries a bevel-wheel drive 20 on the bearing spigot 8, which is connected to the face wall 3 by means of screws 21. A two-piece gear rod 22 leads to the bevel-wheel drive, the parts of said rod being connected to one another by a universal joint 23. In this use of the roller blind box, the slit 14 aligned with the roller blind guide 19 is disposed at the left-hand side of the lower longitudinal wall. For this reason, the guide member 13 has been pushed into the insertion opening 12 positioned at the lower left hand in FIG. 5 of the drawings. The tabs 17 project into the upper portion of the roller blind guide 19. In this embodiment, the window frame and the roller blind box connected thereto are placed as a complete structural unit into a window opening and are secured therein. After anchoring and applying the lintting 24, the entire built-in unit is firmly connected to the wall.

Figure 6:
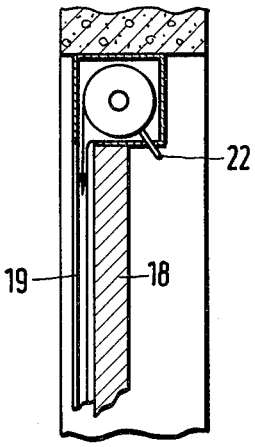
FIGS. 6, 7, 8 and 9 are examples of the roller blind box associated with window openings.

In FIG. 6 of the drawings, it has been illustrated how such a unit is placed into a window opening. The roller blind is in this instance used as left-hand roller, and the roller blind shaft is driven via a gear rod 22.

Figure 7:
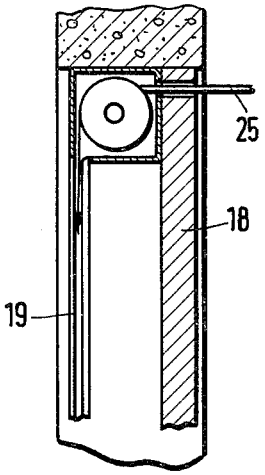

In FIG. 7 of the drawings, as a first example a later buit-in roller blind has been illustrated; it may be assembled as a unit into the window opening in front of the window frame. The two later roller blind guides 19 are thereafter pushed inclined onto the tabs 17 of the guide members 13, moved to the window opening and secured thereto. In this built-in example, the roller blind shaft is driven by a roller blind belt 25 which passes through the top portion of the window frame 18. The roller blind assembly in this instance also is a right-hand roller.

Figure 8:
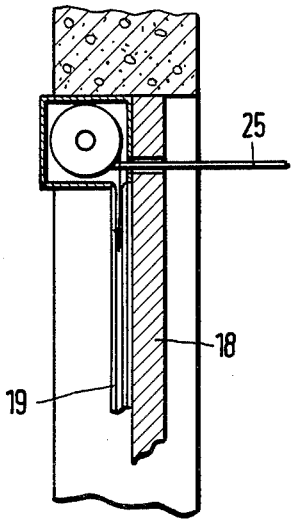

In FIG. 8, the roller blind is assembled as a left-hand roller, so that the roller blind guide 19 directly rests on the outer surface of the window frame 18. Here also the roller blind shaft is driven by a belt 25 which extends through an according opening in the window frame.

Figure 9:
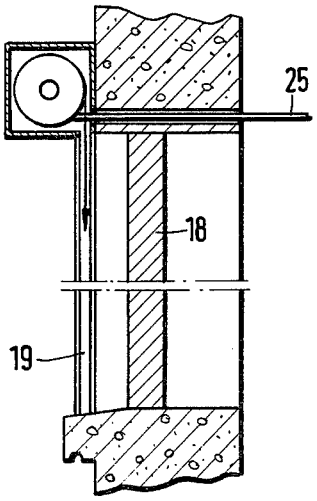

In FIG. 9 of the drawings, an assembly situation has been illustrated in which the roller blind box is applied to the outer surface of the masonry. Here also the roller blind is defined as a left-hand roller, and the roller blind guide 19 rests on the outer surface of the masonry. The belt 25 driving the roller blind shaft extends through a breakout of the masonry.

In order to suffice all requirements of practice, the strips 4, 5, 6, 7 of the face wall are provided with all exit openings for the various drive parts of the roller blind shaft occurring in the possible examples of use. The two lateral strips 5 and 7 have recesses 26 and 27 above the reinforcements 9 and 10. So that selectively a gear rod 22 or a belt 25 may be used, the size of the recesses 26, 27 is selected such that a gear rod 22 is able to pass with clearance.

The strip 6 adjacent to the lower longitudinal wall next to the reinforcements 9 and 10 has recesses 28, 29 corresponding to the recesses 26 and 27, in order to also be able to use gear shafts 22 according to the uses of the roller blind box illustrated in FIGS. 5 and 6. When the roller blind box, as illustrated in FIG. 7, is used, when thus the roller blind shaft is driven by means of a belt 25 and the roller blind is formed as a right-hand roller, the belt 25 extends in the vicinity of the strip 4 and passes through the breakouts in the vicinity of the upper corners of the strips 5 and 6. For this reason, recesses 30, 31 are provided in the strips 5 and 7 in the vicinity of the upper corners of the face wall, said recesses just being so wide that a belt 25 is able to pass through with clearance.

In order to prevent that the belt is damaged at sharp inner edges of the recesses 26 to 31, the inner edges of all recesses are provided with rim beads 32. The free edge portion of each face wall disposed outside of the strips 4, 5, 6 and 7 has coextensive thereto fastener openings 33. Through these fastener openings 33, fastener elements may be introduced up to in the faces of the longitudinal walls, in order to connect all structural parts of the roller blind box into a rigid unit.

I claim:

1. A roller blind box comprising four longitudinal walls; two face walls each having four strips projecting from one side thereof, one of said four strips being a lower strip, said two face walls being inserted between said longitudinal walls and kept in contact with said longitudinal walls by said four strips projecting from said one side of each said face wall; a respective spigot projecting from said one side of each said face wall for supporting a roller blind shaft having an axis, said face walls being symmetrical with respect to a vertical central plane substantially perpendicular to and containing the axis of the roller blind shaft; lateral roller blind guide rails and releasable guide members, said face walls being connected to said lateral roller blind guide rails via said releasable guide members; and an insert opening in said lower strip of each said face wall in vicinity of corners for receiving a respective one of said guide members.

2. A roller blind box, as set forth in claim 1, wherein each said insert opening is polygonal in shape and merges into a respect insert duct which is closed at its end remote from its associated said insert opening.

3. A roller blind box as set forth in claim 1, wherein said strips have a width exceeding the width of a face wall roller blind belt.

4. A roller blind box as set forth is claim 3, wherein said strips of each said face wall have next to associated said insert openings and recesses for the passage of a roller blind belt recesses for passage of a rod of a rotary drive for the roller blind shaft.

5. A roller blind box as set forth in claim 1, wherein each said guide member includes an insert arbor which in cross-section corresponds to the shape and size of a corresponding said insert opening and an entry guide positioned adjacent to an external end of said insert arbor.

6. A roller blind box as set forth in claim 5, including tabs projecting from said entry guide, said tabs being introducible into said roller blind guide rails.

7. A roller blind box as set forth in claim 1, wherein said face walls are covered by plates which have a passage opening for said roller blind shaft, said roller blind shaft having a cylindrical end portion and wherein an annular gap is provided between said end portion and said passage opening has its edge closed by a seal.

* * * * *